US005992542A

United States Patent [19]

Rives

[11] Patent Number: 5,992,542

[45] Date of Patent: Nov. 30, 1999

[54] CANTILEVERED HOLE OPENER

[76] Inventor: Allen Kent Rives, P.O. Box 15903, Spring, Tex. 77068

[21] Appl. No.: 08/945,778

[22] PCT Filed: Feb. 28, 1997

[86] PCT No.: PCT/IB97/00358

§ 371 Date: Jan. 8, 1998

§ 102(e) Date: Jan. 8, 1998

[87] PCT Pub. No.: WO97/34071

PCT Pub. Date: Sep. 18, 1997

Related U.S. Application Data

[60] Provisional application No. 60/012,609, Mar. 1, 1996.

[51] Int. Cl.[6] ..... E21B 10/20; E21B 10/22

[52] U.S. Cl. ..... 175/53; 175/344

[58] Field of Search ..... 175/344, 334, 175/368, 53

[56] References Cited

U.S. PATENT DOCUMENTS

| | | | |
|---|---|---|---|
| 2,058,628 | 10/1936 | Reed | 175/344 |
| 2,557,619 | 6/1951 | Swart | 175/344 |
| 2,941,785 | 6/1960 | Kammerer | 175/344 X |
| 3,016,099 | 1/1962 | Woodruff | 175/344 |
| 4,036,314 | 7/1977 | Dixon et al. | 175/364 |
| 4,600,064 | 7/1986 | Scales et al. | 175/368 |
| 4,614,242 | 9/1986 | Rives . | |
| 4,915,181 | 4/1990 | Labrosse | 175/263 |
| 5,035,293 | 7/1991 | Rives . | |
| 5,337,843 | 8/1994 | Torgrimsen et al. | 175/334 |

OTHER PUBLICATIONS

Baker Hughes Mining Tools Product Catalog, published 1988 (16 pages).

Inrock Drilling Systems, Inc. Product Brochure for Yo–Yo Reamer, date of publication unknown (2 pages).

Polish Mining Tool with removable cutter shells, date unknown, drawing and photograph supplied to applicant by customer (2 pages).

*Primary Examiner*—Frank Tsay

[57] ABSTRACT

A hole opener for enlarging the diameter of bore holes, having a plurality of cantilevered spindles (6) for supporting rotatably attached cutter shells (9) having hardened surfaces for cutting and crushing to widen the bore hole. The cutter shells are supported on an inner threaded journal (13) which permits a plurality of load bearing rollers or bearings (26) to facilitate rotational movement of the cutter. The hole opener is provided on a tubular body which is connected in a drill string and which provides jetting nozzles (4) to remove the cutting debris and return it to the earth's surface. The cantilevered support spindle (6), journal (13) and cutter shell (9) assembly permit flexible interchange of cutter faces and sizes to be available for use with the same hole opener body and different directions of travel of the body.

13 Claims, 5 Drawing Sheets

CANTILEVERED HOLE OPENER

RELATED CASES

This application claims priority to my provisional patent application, Ser. No. 60/012,609, filed Mar. 1, 1996, and PCT application, Ser. No. PCT/IB97/00358, filed Feb. 28, 1997, for the same invention.

BACKGROUND OF INVENTION

This invention relates to hole openers, specifically to openers which are designed to enlarge the diameter of drilled holes.

Drillers commonly have drilled holes and thereafter enlarged the hole for the intended purposes with hole openers and reamers which are designed to enlarge the diameter of the pilot hole or original bore diameter. Most openers or reamers known to applicant are devices having the cutting surfaces mounted on support arms which are mounted on the opener body and having their radial axis directed inward to support the rotating cutter head. The abrasion and load experienced by such bodies wears the outer surfaces of the support arms as the opener moves through the formation to be opened and ultimately may cause the support arms to fail.

The normal operating problems of conventional hole openers or reamers is exacerbated when drilling horizontal or near horizontal applications. In such situations, the load and wear characteristics on the support arms may cause early and catastrophic failure of the arm structure and often results in loss of cutters in the borehole itself. Additionally, in horizontal or near horizontal applications, the support arms of conventional openers create additional torque on the tubular string which carries the hole opener body. These problems may cause failure of both the support arms and loss of cutters in the hole requiring expensive retrieval operations and delay the completion of the operation.

Other economical considerations warrant consideration. In conventional hole openers, the hole opener body is limited by its design to essentially one-size of diameter. The design of the conventional hole opener does not permit alternative sizes of holes to be made with the same body because the span of the support arms fits only one size of cutter. If alternative diameter holes are required, a whole new body must be acquired to open the hole. This requires additional trips into and out of the hole to change the opener and cutter body. Additionally, conventional hole openers are designed to operate in pilot holes which must be provided to accommodate the large profile of the support arm and the cutter. The larger pilot hole requires a larger size bit in the initial drilling operation which is more costly to drill than one using a smaller bit. Finally, changing the cutters on conventional hole openers is time consuming, if it can be accomplished at all, and often requires repair to the opener body and support arms due to damage caused by the pins and locking devices used to secure the cutters to the conventional opener body. Conventional openers typically have welded support arms carrying the cutter and removal of the cutter would entail removing the support arms and re-welding the new support arms after replacing the cutter itself. This extraordinary amount of work generally causes the used or damaged conventional hole opener to be scrapped rather than repaired.

OBJECTS AND ADVANTAGES

Accordingly, several of the objects and advantages of the present invention may be readily appreciated from the disclosure of the present invention.

Since the present invention has eliminated the support arms which previously supported the cutters, repair of the cutters when needed is accomplished quickly and cheaply. Replacement of the existing size of cutters with either larger or smaller cutters allows a single cutter body to be used for many different size hole openings. The cost of replacing damaged cutters is significantly smaller than replacing the complete hole opener assembly. The diminished size of the body carrying the cutters has significantly decreased the weight and portability of the hole opener. Conventional hole openers, because of their mass, require special handling to install and replace at the job site. The present invention is compact and significantly lighter than the conventional devices permitting easy installation, removal and replacement.

Another feature of the present invention is that only the cutters engage the formation to be cut. Conventional cutters were supported by support arms which supported the distal end of the cutter body. With the present invention, the cutter is supported by the cantilevered spindle which makes the profile of the cutter within the annulus more compact because there is no dragging of the support arm past the formation opened by the cutter. This feature also reduces the drag and torque on the body itself and on the whole drill string thereby reducing mechanical wear on the drilling assembly from this operation. The tubular member carrying the hole opener experiences less torque than prior conventional hole openers and requires less mechanical energy to open the hole to the desired inner diameter.

Since the cutters may be interchanged to provide alternative cutting surfaces utilizing the same opener body, another feature of the present invention provides that numerous hole sizes may be accommodated with the same opener body. This feature of the invention will allow a single opener body to be taken to a job site and used throughout the drilling process and merely upgraded by replacement cutters having alternative cutting characteristics or alternative diameter cutting surfaces.

A still further benefit of the present invention is that it permits a smaller pilot hole to be used to provide the initial pathway for the driller. Since the overall outer diameter profile of the opener body is smaller than conventional openers, a smaller and therefore more economical pilot hole may be drilled. Drilling of a smaller pilot hole may be accomplished more quickly than drilling a larger diameter pilot hole and may be accomplished by a smaller drilling rig which is also more economical.

Another advantage of the present invention can be appreciated because the worn cutters may be easily and quickly replaced by rig personnel without special tools or equipment by unscrewing the worn cutters and screwing on the replacement cutters. With conventional hole openers and reamers, the whole assembly typically was returned to a central shop for repair or replacement if worn cutters needed to be changed.

BEST MODE FOR PRACTICING THE INVENTION

Figure 1:
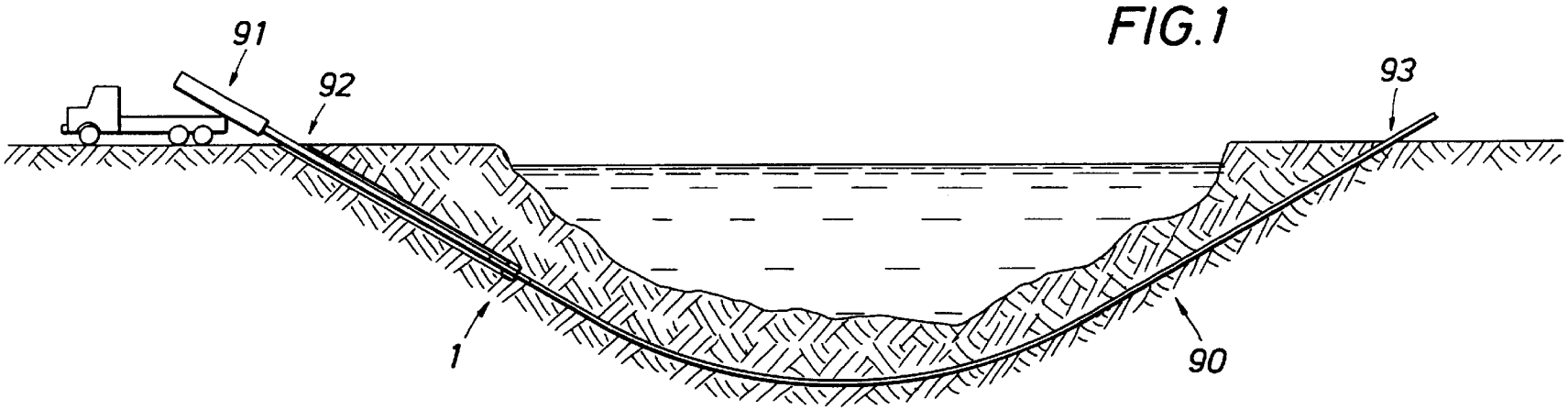
FIG. 1 is a perspective drawing of the use of a hole opener to enlarge the diameter of a hole which has been drilled under a body of water.

One form of the device of the present invention will be described in detail in operation. The use of the hole opener is illustrated in FIG. 1 which discloses a river crossing operation wherein a pilot hole 90 has been previously drilled by the drilling rig 91 and a larger diameter hole is desired. The hole opener is then engaged to open the hole created by the pilot hole to the desired inner diameter. When the operation is intended to burrow under a obstacle such as the river as disclosed in FIG. 1, but which also may be a highway or other obstruction, the hole opener of the present invention is small and light enough to be threadably attached by hand and may be used either on the ingress 92 of the tubular or the egress side 93 as the tubular member is backed out of the initial pilot hole thereby saving additional time in the overall drilling operation. It may be readily appreciated that the invention disclosed herein may be used in any drilling operation, whether horizontal or vertical, and the choice of illustration in FIG. 1 is not intended to limit the application to this type of drilling alone. The preferred embodiment of the present invention is more clearly set forth in FIGS. 3, 4 and 5.

Figure 2:
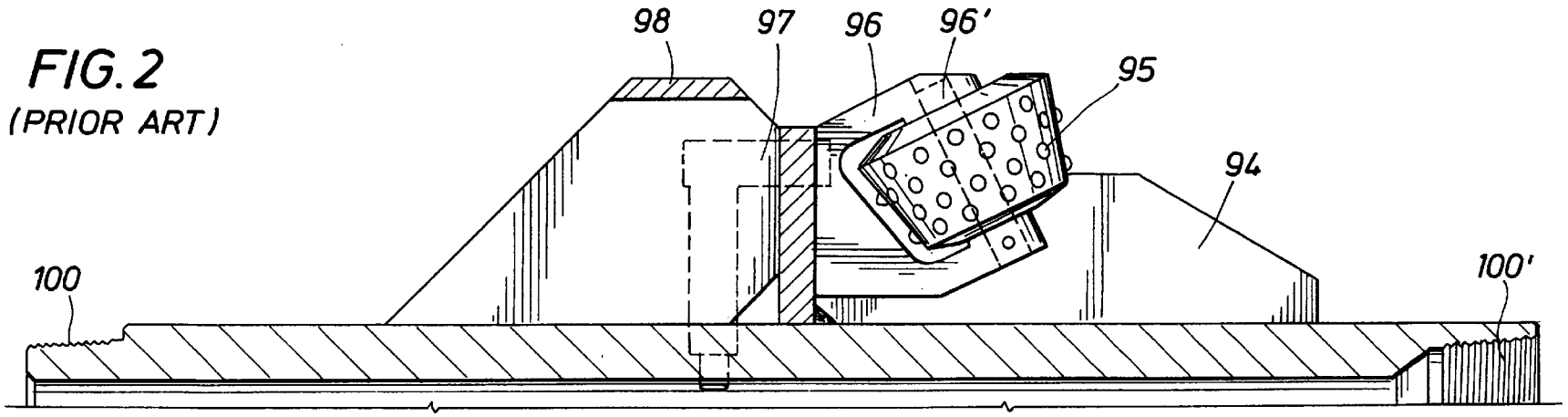
FIG. 2 (PRIOR ART)
FIG. 2 is sectional drawing of a prior art device showing the relative displacement of the cutter arm, guide and cutter on the prior art device.

FIG. 2 illustrates a typical prior art device used to open a drilled hole. The reamer is threadably engaged to a drill string by means of the pin 100 and box end 100 and lowered into the well bore. The pilot guide 94 directs and centralizes the reamer in the hole and the cutter 95 engages the surface to be enlarged. The cutter 95 is supported on a pin 96' carried by the support arm member 96. As the cutter 95 is turned to cut or crush the surface to be opened, the jetting arrangement 97 clears the crushed materials from around the cutter face and the cutting debris is lifted in the annular space-by this fluid flow. Following the support arm is a circumferentially spaced wear ring 98 which is tipped with a hardened face, such as carbide facing, which rides on the annular space opened by the cutter to provide stability for the cutter and provide lateral support for the critical support arm 96.

As the abrasive materials flow back past the support arm, the arm itself wears and will sometimes fail allowing the cutter to become dislodged in the hole and greatly increasing the time required to retrieve the body and the dislodged parts. Even angular movement of the pin 96' in the worn support arm will subject the cutter to substantial forces and cause failure. The prior art device shown in FIG. 2 is typical of prior art reamers and hole openers.

Figure 3:
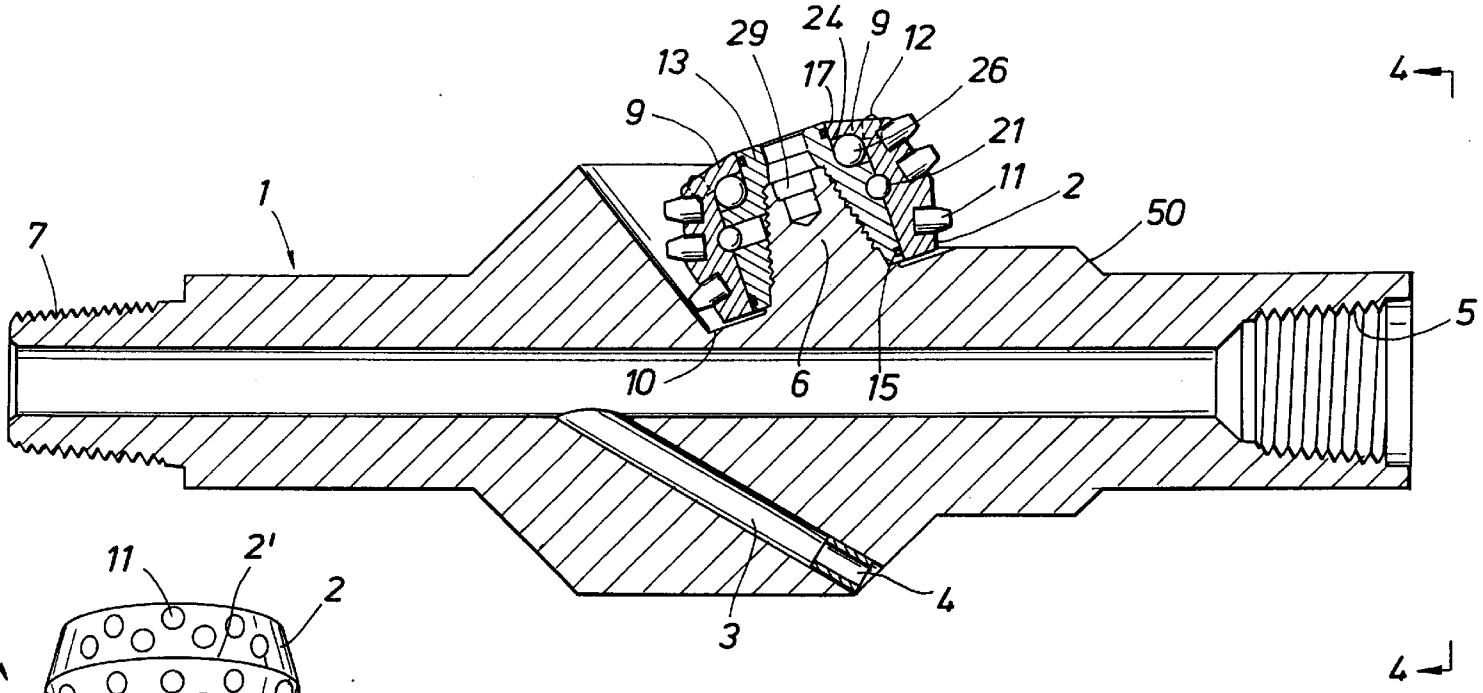
FIG. 3 is a sectional view of the preferred embodiment of the invention.

As shown in FIG. 3, the preferred embodiment of the present invention is fashioned on a tubular member or body 1 which is provided with standard threaded box 5 and pin 7 for attachment in a drill string to enable it to be either pushed or pulled through the well bore as desired or necessary. The tubular member 1 receives in operation drilling fluids therethrough to be circulated into the well bore and then pumped out of the well bore and back to the earth's surface along with the cuttings resulting from the opening operation. As further shown in FIGS. 3–4, the hole opener body 1 is fashioned on a tubular member and provides a plurality of nozzle ports 3 and nozzles 4 interposed between cutter shells 9 to deliver jetting circulation to clean the debris from the well bore. Jet nozzle 4 may be changed to accommodate a variety of pump capacities and hydraulic programs. It may also be appreciated by one skilled in the art that the present invention may also be used in air drilling operations and the jet nozzle may be modified to accomplish air blast nozzles to clean debris from the well bore.

The member or body 1 as well as the cutter shells 9 are formed of any suitable high strength steel which is well known to those skilled in the art. The cutters may assume any suitable configuration to accomplish the desired results; but preferably include a bottom surface represented generally at 2 which, when the cutter elements are positioned on the support spindles 6 which project or extend outwardly therefrom as shown.

The cutter elements, cutter body and load bearing elements are supported on a plurality of cantilevered support spindles 6 integrally formed on the tubular body 1, or fixedly attached to the tubular body 1 as by welding to form an integral body, at an angle in order that the cutter elements 11 may be exposed to the formation in the desired manner.

As disclosed in FIG. 3, hole opener 1 is fashioned from a tubular blank onto which is fashioned a plurality of cantilevered support shafts 6 which are machined to accept the individual cutter body journal 13. Outwardly from the recessed surface 10, the cantilevered support spindle 6 is threaded to receive the cutter body journal 13 and machined to provide a lock means 29 to prevent the cutter body journal 13 from disengaging from the support spindle 6 during operation.

The cutter body journal 13 supports the cutter shell 9 which provides the matrix onto which the hardened cutter buttons 11 are attached. The cutter shell is fabricated to allow an outer ball bearing race 24 and a plurality of ball bearings 26, which provide load bearing capacity both longitudinally and laterally. A second ball bearing race 19 and plurality of ball bearings 21 provide additional load bearing capacity.

By further reference to FIG. 3, the cutter shell 9 and cutting surface 2 is guided into the pilot hole with pilot guide 50 which centralizes the cutter body within the pilot hole which is to be enlarged. Cutter body shell 9 is rotatably attached to the cantilevered support spindle 6 and disposed on cutter body journal 13 which is threadably attached to the support spindle 6. Cutter body journal 13 provides a plurality of load bearing support means to provide rotatable support to the cutter body 9 in the form of roller or ball bearing races. Cutter body journal 13 is sealed to provide protection to the bearing surfaces by seal means at 15 and 17. The seal means are standard elastomeric O-rings or other seal means well known to those skilled in the art.

Figure 4:
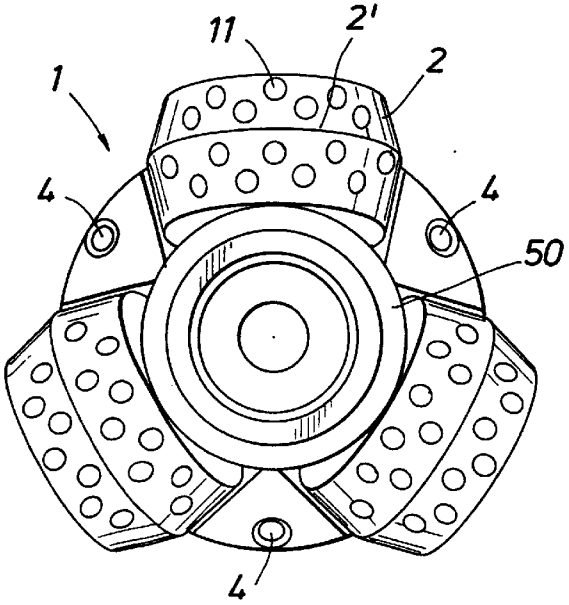
FIG. 4 is a sectional view of the preferred embodiment of the invention taken along line 4—4 of FIG. 3.

FIG. 4 illustrates the axial view of the preferred embodiment of the present invention along the line 4—4 of FIG. 3 showing three cutters on the member 1, but such number is purely for purposes of illustration only. For example, when a hole opener is employed to enlarge a well bore from six inches to twelve inches, three cutter bodies 2 may be employed, but where the hole is to be enlarged from seventeen and a half inches to twenty inches, the number of cutter bodies by way of example only, may be four or five, but any other number may be employed to accomplish the desired results.

The cutting surfaces 2 are disposed to provide the enlargement of the hole and provide the maximum pathway for clearing the cutting debris from the well bore.

Figure 5:
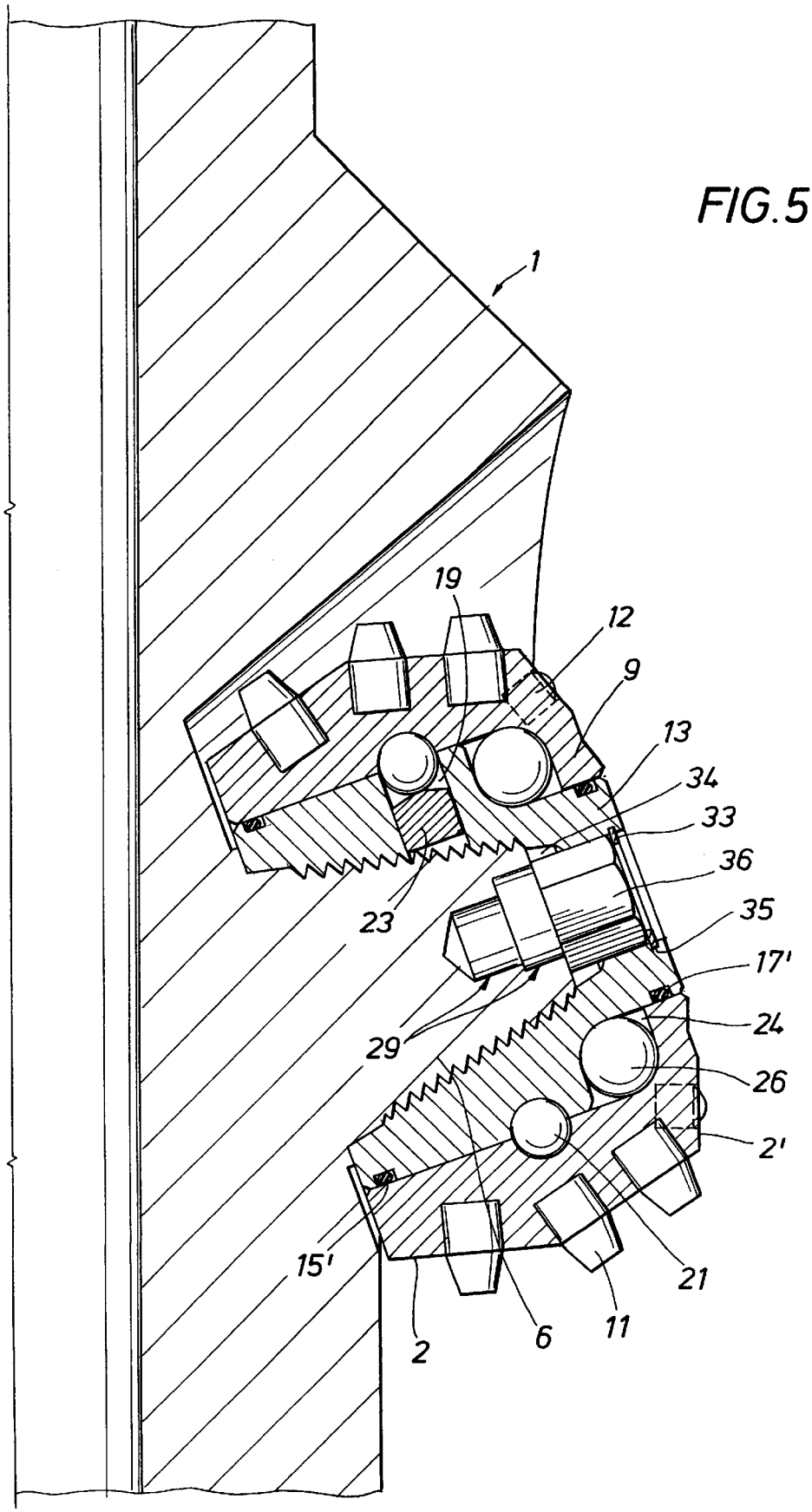
FIG. 5 is another plan view of the preferred embodiment of the invention.

As illustrated in FIG. 5, the cutter body journal 13 and cutter shell 9 is supported on the cantilevered support spindle 6 by several load bearing means 21, 26. The cutter body journal 13, as shown in FIG. 5, provides an inner ball race 19 and ball bearings 21, and outer journal ball bearing race 24 and ball bearings 26. The cantilevered support spindle 6 may be either integrally fashioned from the tubular member or body 1 or by welding a support spindle into a recessed area of the tubular body 1 by techniques well known to those skilled in the art. Additional roller bearing members (not shown) may be provided between the inner ball bearing race 19 and the seal means 15. The manner and method of placement of these additional bearings is shown generally at 25 in FIG. 6.

The cantilevered support spindle 6 shown in FIG. 5 is conical and threaded to engage the cutter journal 13. The support spindle 6 in the preferred embodiment further provides a recess 29 which is eccentric of the principal axis of the support spindle to provide locking engagement with hexagonal lock plug 36. The lock plug 36 is secured within the journal 13 by retainer ring 33 which snap seats in recessed groove 35. Support spindle 6 is angled from a line perpendicular to the cutter body 1 at an angle ranging from 15° to 25°. The preferred embodiment spindle is angled at 20° from a line perpendicular to the central longitudinal axis of the tool body 1. Journal 13 further provides an eccentric hexagonal recess 34 into which seats, upon assembly, lock plug 36. Recess 29 provides the seat for lock plug 36 which extends through journal 13 to eccentrically engage in support spindle 6 to prevent backing-off of the cutter 9 in operation.

The journal 13 of FIG. 5 provides recessed grooves 15 and 17 for elastomer O-rings 15' and 17' to prevent the ingress of abrasive materials from the cutting environment and to retain the lubricant materials which are packed around the journal upon assembly. The journal 13 further provides an outer ball bearing race 24 which provides load bearing surfaces for both the longitudinal forces and the transverse forces experienced by the cutter in operation. A plurality of outer ball bearings 26 are loaded into the journal body upon assembly and before engagement with the cantilevered support spindle 6. An inner ball bearing race 19 and plurality of ball bearings 21 provide further load bearing capacity for the cutter body. The inner ball bearings 21 are retained in the journal race by retainer plug 23 and are similarly loaded into the journal body 13 prior to engagement with the cantilevered support spindle 6. An additional roller bearing (not shown) may be provided in another bearing race area between the inner ball bearing race and the lower O-ring groove 15; and may be assembled prior to engagement of the cutter body on the support spindle 6 in a manner similar to the ball bearings described herein and as more generally described in FIG. 6 at 25.

In order to provide the ability to use the hole opener in either direction, the cantilevered support spindle 6 may be threaded to accept either right-hand threads or left-hand threads or both. The spindle may be machined to accept both right and left hand threads permitting journals having either right hand or left hand threads to be used when using the hole opener in the ingress manner or in the egress manner.

The dihedral cutting face 2 of the cutter shell 9 of FIG. 5 is fitted with a plurality of tungsten carbide buttons 11 around the periphery of the shell. Carbide wear buttons 12 are located around and on the distal edges of the shell 9 to prevent undue wear from the lateral well bore wall. The angle of the dihedral face is between 10° and 25° from the tangent to the outermost point on cutter face 2' and which is parallel to the axis of rotation of the support spindle 6. Although the preferred embodiment is shown as a dihedral face having an angle of 15° from the tangent to the outermost point of the cutter face 2', other angles and other generally arcuate forms may be provided to provide similar action of the cutter face.

Figure 5A:
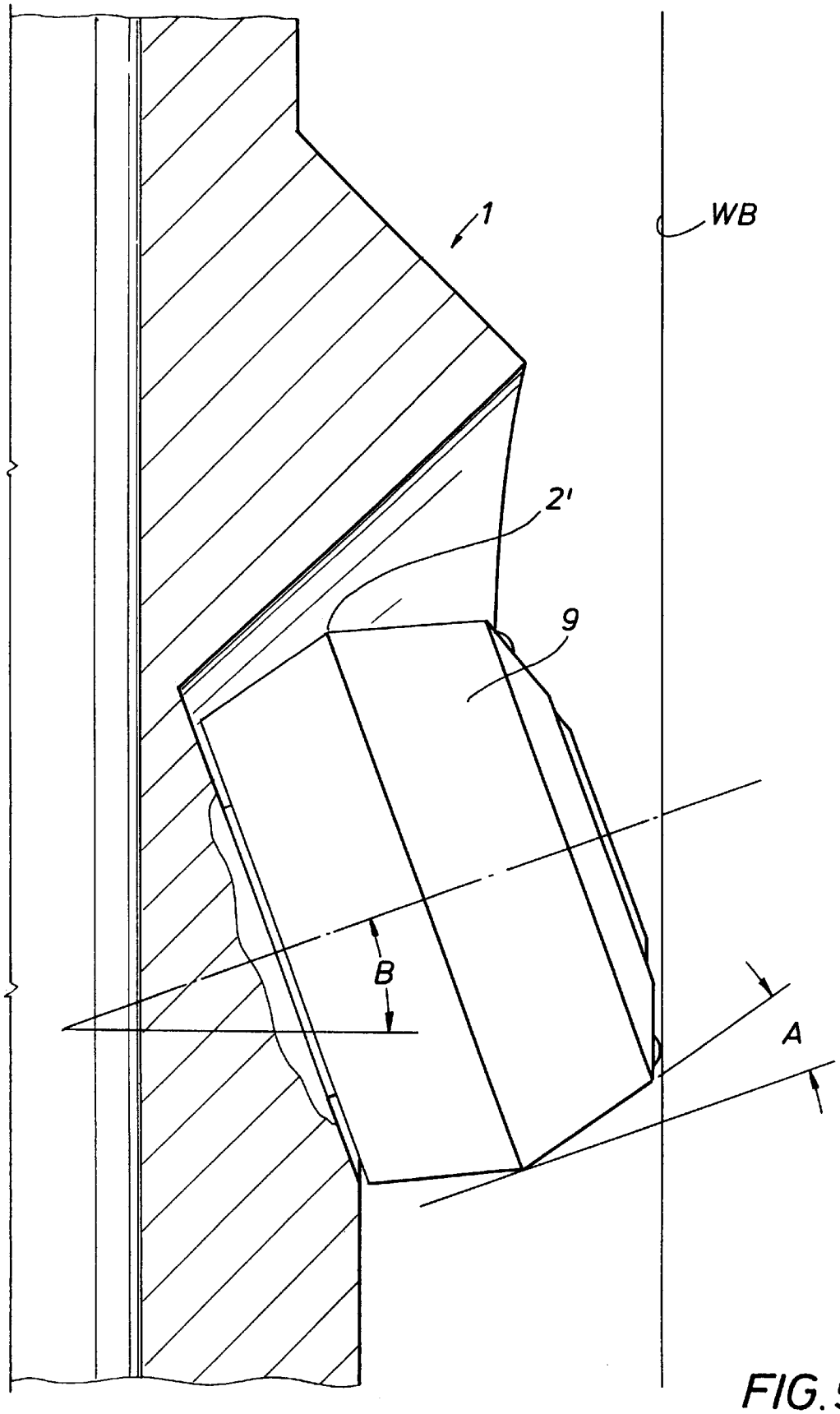
FIG. 5A is a schematic drawing of the preferred embodiment of the invention disclosing the relationship of the spindle angle and the cutter face angle.

As shown in FIG. 5A, the angle of the dihedral cutting face A is coordinated with the angle of the spindle B to provide the maximum amount of cutting surface, the most appropriate angle of contact with the formation to be cut, and to provide clearance of the distal edge of cutter 9 with the well bore WB. The diameter of cutter 9 must be set to allow the cutter to roll without galling or scuffing the outer well-bore wall WB to minimize wear on the distal edge and prevent excessive torque from the cutter dragging along the external well bore face. In the preferred embodiment, dihedral angle A is 15° and cantilevered support spindle angle B is 20°.

Figure 7:
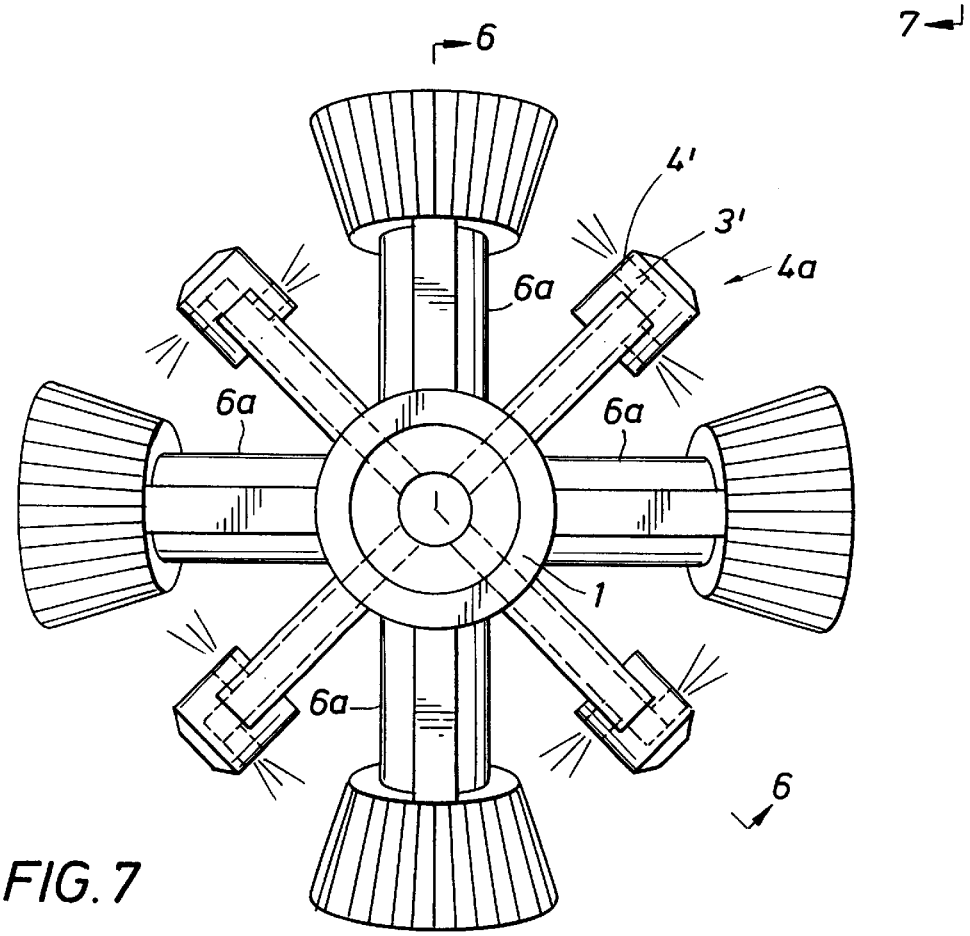
FIG. 7 is an axial view of an alternative embodiment of the invention showing an alternative type of cutter used on the invention.

As previously noted, the cutting elements illustrated in FIGS. 3, 4, and 5 are shown as tungsten carbide buttons. If desired, cutter shell may be of any suitable configuration of hardened surface, such as, by way of example only, mill tooth such as shown in FIG. 7 at 11', which are well known to those in the art. Large mill tooth cutters are typically chosen for soft or medium formations, with the carbide button arrangement shown in FIG. 5 for harder rock formations. The cutting faces of these shells are formed of any suitable and well-known hard materials such as by way of example only sintered tungsten carbide or polycrystalline diamond facings. The choice and suitability of these materials is well known to those skilled in this art.

Figure 6:
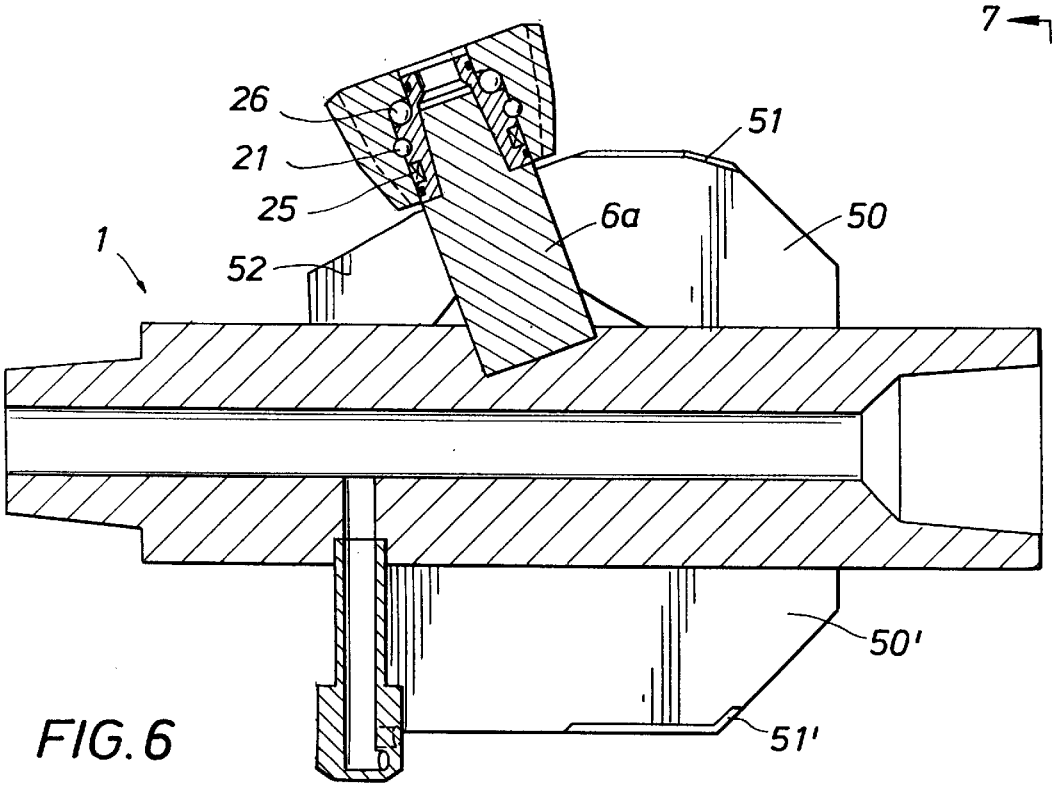
FIG. 6 is a partial sectional view of an alternative embodiment of the invention disclosing the mounting of the cutter on a guide.

FIGS. 6 and 7 illustrate an alternative form of the invention for use in larger diameter holes and with an alternative form of cutter body. FIG. 6 discloses a hole opener with cantilevered support spindle **6*a* attached to the tubular member or body 1 by welding. The support spindle 6*a* is further supported on the body by pilot guide 50 and gusset 52 which are attached to the member 1 and to the support spindle 6*a* by welding. FIG. 6 further discloses an alternative arrangement with the cutter journal 13 providing a plurality of load bearing means, shown generally as including at least a row of roller bearings 25 and two ball bearing arrangements 21 and 26**.

FIG. 6 further discloses an alternative form of jetting nozzle and port arrangement **4*a* which is fashioned by affixing said nozzles on the distal ends of hollow members 5 welded to the body 1 which provide bi-directional release of fluid from the annulus of the body 1 through port 3' and nozzle 4' toward the adjacent cutter. The plurality of jetting nozzle members are additionally supported on the body 1 by attachment to guide 50' which is hardfaced 51' to prevent excessive wear. Each nozzle member provides two separate fluid paths which are directed at the adjacent cutters to provide lubrication and removal of the debris from the cutting process. FIG. 6 discloses a sectional view along the line 6'—6' for the nozzle member axis and along the line 6"—6"** for the cutter axis.

FIG. 7 discloses the alternative embodiment illustrated in the profile of FIG. 6 from an axial perspective and demonstrates a spatial arrangement of plurality of cutter support spindles **6*a* consisting of four separate spindles attached to the tubular member or body 1. FIG. 7 further discloses a mill tooth cutter 11' as an alternative cutter arrangement to those described in FIGS. 3, 4, and 5. The cutters disclosed in FIG. 7 are interchangeable with the cutters shown in FIGS. 3, 4, and 5. This interchangeability permits economical use of the tubular body for multiple applications. The mill tooth cutter crushes and gouges the formation with the cutting debris being carried away by fluid directed by the jet nozzle arrangements shown at 3' and 4' which provide the same debris removal force of fluid spray as those described and shown in FIG. 3**.

The cantilevered support spindle feature of the present invention permits the use of a variety of cutter shell sizes to be offered which may be used on the same tubular member or body 1. The width of the cutter shell can be increased thereby increasing the cutting diameter of the hole opener. Alternative load bearing capacities and modalities may be offered by modifying or changing the journal 13 to provide more or fewer ball bearing races, more or fewer roller bearing surfaces.

The foregoing disclosure and description of the invention are illustrative and explanatory thereof, and various changes in size, shape and materials as well as in the details of the illustrated construction may be made without departing from the spirit of the invention. Although the description above contains many specific features, these should not be construed as limiting the scope of the invention but as merely providing illustrations of some of the presently preferred embodiments of the invention.

What is claimed is:

1. A hole opener for widening the diameter of a bore hole comprising:

a tubular member having threaded connections on each end of said member for connection in a drill string;

a plurality of integral cantilevered support spindles extending from the tubular member;

an interchangeable journal providing load bearing means connected to each cantilevered support spindle on said tubular member; and, an interchangeable cutter shell supported on each journal providing hardened surfaces for engaging a surface of the bore hole to be cut, wherein the journal and cutter shell on each cantilevered support spindle may be changed to permit the opening of more than one hole size utilizing the same tubular member.

2. The hole opener of claim 1 wherein the tubular body provides a plurality of jetting nozzles interposed between the cantilevered support spindles.

3. The hole opener of claim 1 wherein each integral cantilevered support spindle extending from the tubular member is threaded for both right hand and left hand threads for use with either a right hand thread cutter journal or a left hand cutter journal.

4. The hole opener of claim 1 wherein each cutter shell is formed with a dihedral cutting face.

5. The hole opener of claim 4 wherein each cutter shell is formed with a plurality of sintered tungsten carbide buttons on each surface of the dihedral face.

6. The hole opener of claim 5 wherein the integral cantilevered support spindle is angled about 15–25° from a normal to the tubular member, and away from the cutting surface, and the distal face of the dihedral cutter shell is angled about 10–25° from the axis of rotation of the cutter shell, whereby the cutter shell will roll without scuffing the outer surface of the hole being widened.

7. The hole opener of claim 4 wherein each cutter shell is formed with a plurality of hardened buttons on each surface of the dihedral face.

8. A hole opener for widening the diameter of a pilot hole comprising:

a cutter support body for insertion in a pilot hole by attachment between two sections of a drill string, a plurality of cantilevered support spindles permanently affixed to the cutter support body, an interchangeable cutter journal threadably connected to each cantilevered support spindle, an interchangeable cutter shell disposed on each cutter journal with suitable hardened face to cut and crush the face of the formation and widen the diameter of the pilot hole, sealed load bearing and rolling means disposed between each said journal and each said cutter shell on each said spindle to permit rotational and load bearing movement of the cutter shell.

9. A hole opener for widening a large diameter bore hole comprising:

a tubular body threadably connected at each end to a drill string providing a fluid passage throughout its longitudinal axis, a plurality of threaded spindles circumferentially fixed on said body and individually supported thereon by a permanently affixed pilot guide and gussett, an interchangeable journal threadably engaging each spindle providing a plurality of bearing race surfaces on an outer surface of said journal, load and roller bearings engaging the journal and being supported on the race surface of said journal, an interchangeable cutter shell for each journal providing a rotating surface which provides a hardened surface for cutting and crushing the engagement surface of the well bore, a plurality of jetting nozzle members providing a path from the fluid passage of the tubular body to a distal portion of such jetting nozzle member and providing one or more ports for each such jetting nozzle member with said jetting nozzle members being alternately affixed to the tubular member with the threaded spindles, to direct the flow of fluid toward the engagement surface of the well bore, a jetting nozzle guide rigidly affixed to each jetting nozzle and to the tubular body.

10. The hole opener of claim 9 wherein the cutter shell is formed with a hardened face of a striated grooves for use in soft or unconsolidated formations of rock.

11. The hole opener of claim 9 wherein the guides supporting each jetting nozzle and spindle are hard-faced to prevent excessive wear of the guide.

12. A method for widening a bore hole in the earth by rotating a tubular body having circumferentially spaced cantilevered spindles carrying rotatable cutting surfaces for cutting and crushing the surface adjacent the bore hole of a previously drilled pilot hole, comprising the steps of:

connecting the tubular body to a drill string with the cutting face being selected to face the direction of travel of the drill string from the ingress side of the pilot hole to the egress side of the pilot hole;

moving the tubular body into the bore hole so that the rotatable cutting surfaces are in a position to contact the bore hole to be widened;

rotating, circulating, and providing longitudinal movement of the drill string to engage, cut, and crush the bore hole.

13. A method for widening a bore hole in the earth by rotating a tubular body having circumferentially spaced cantilevered spindles carrying rotatable cutting surfaces for cutting and crushing the surface adjacent the bore hole of a previously drilled pilot hole with a drill string passing therethrough, comprising the steps of:

connecting the tubular body to the drill string with the cutting face being selected to face the direction of travel of the drill string from the egress side of the pilot hole to the ingress side of the pilot hole;

moving the tubular body into the bore hole so that the rotatable cutting surfaces are in a position to contact the bore hole to be widened;

rotating, circulating, and providing longitudinal movement of the drill string to engage, cut, and crush the bore hole.

* * * * *